US006414640B1

(12) United States Patent
Eggleston

(10) Patent No.: US 6,414,640 B1
(45) Date of Patent: Jul. 2, 2002

(54) ANTENNA ASSEMBLY, AND ASSOCIATED METHOD, WHICH EXHIBITS CIRCULAR POLARIZATION

(75) Inventor: Steve Eggleston, San Diego, CA (US)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/675,684

(22) Filed: Sep. 29, 2000

Related U.S. Application Data

(60) Provisional application No. 60/197,712, filed on Apr. 18, 2000.

(51) Int. Cl.[7] ..... H01Q 1/38
(52) U.S. Cl. ..... 343/702; 343/700 MS
(58) Field of Search ..... 343/702, 700 MS, 343/846, 795; 455/90

(56) References Cited

U.S. PATENT DOCUMENTS 5,455,596 A * 10/1995 Higashiguchi et al. ..... 343/741
5,835,063 A * 11/1998 Brachat et al. ..... 343/700 MS

FOREIGN PATENT DOCUMENTS

| | | | |
|---|---|---|---|
| JP | 11274843 | 10/1999 | ..... H01Q/13/08 |
| WO | WO 00/03452 | 1/2000 | ..... H01Q/1/24 |

* cited by examiner

*Primary Examiner*—Don Wong
*Assistant Examiner*—James Clinger
(74) *Attorney, Agent, or Firm*—Milan I. Patel

(57) ABSTRACT

An antenna assembly, and an associated method, for a radio device, such as a portable mobile station. The antenna assembly includes a TOPIFA (Top-Mounted Inverted F-Antenna) transducer coupled to a substrate, such as a printed circuit board. The dimensions of the substrate are selected such that the geometric mean of the widthwise and lengthwise dimensions thereof define a geometric mean which correspond to the resonant length at which the mobile station, or radio device, is to be operated.

18 Claims, 7 Drawing Sheets

ANTENNA ASSEMBLY, AND ASSOCIATED METHOD, WHICH EXHIBITS CIRCULAR POLARIZATION

CROSS REFERENCE TO RELATED APPLICATIONS

The present application claims priority of provisional application, application Ser. No. 60/197,712, filed on Apr. 18, 2000.

The present invention relates generally to antenna transducer apparatus used to transduce radio frequency signals, such as radio frequency signals generated by, or received at, a portable mobile station operable in a cellular, or other, radio communication system. More particularly, the present invention relates to an antenna assembly, and an associated method, of dimensions permitting its housing within the housing of the portable mobile station, or other radio device. The antenna assembly includes a substrate of dimensions which causes an antenna transducer element positioned thereupon to exhibit circular polarization.

BACKGROUND OF THE INVENTION

The use of wireless communication systems has achieved wide popularity in recent years as a result of advancements in communication technologies. Multi-user, wireless communication systems of improved capabilities are regularly utilized by large numbers of consumers to communicate both voice and non-voice information.

In a wireless communication system, a communication channel formed between a sending station and a receiving station is a radio channel defined upon a portion of the electromagnetic spectrum. Because a radio channel forms a communication link between the sending and receiving stations, a wireline connection is not required to be formed between the sending and receiving stations to permit the communication of data between the stations. Communication by way of a wireless communication system is thereby permitted at, and between, locations at which the formation of a conventional wireline connection would not be practical. Also, installation of the network infrastructure required of a radio communication system is generally more economically installed in contrast to a conventional wireline system as the infrastructure costs associated with a wireline communication system are significantly reduced.

A cellular communication system is exemplary of a wireless, multi-user radio communication system which has achieved wide levels of usage and which has been made possible due to advancements in communication technologies. A cellular communication system is typically formed of a plurality of fixed-site base stations installed throughout a geographical area and which are coupled to a public network, such as a PSTN (Public-Switched, Telephonic Network), or a packet data network, such as the Internet backbone. Portable transeivers, typically referred to as mobile stations, mobile terminals, or cellular phones, communicate with the base stations by way of radio links.

A cellular communication system efficiently utilizes the portion of the electromagnetic spectrum allocated thereto. Because of the spaced-apart positioning of the base stations, only relatively low-power signals are required to effectuate communications between a base station and a mobile station. As a result, the same frequencies can be reused at different locations throughout the geographical area. Thereby, communications can be effectuated between more than one set of sending and receiving stations concurrently at separate locations throughout the area encompassed by the cellular communication system.

In a cellular communication system, as in other types of radio communication systems, a transmitting station modulates data to be communicated to a receiving station upon a carrier wave of a carrier frequency within the range of frequencies which defines, at least in part, the communication channel. Through such a modulation process, a baseband level signal of which the data is formed is converted into a radio frequency signal of desired frequency characteristics.

A transmitting station, operable to transmit radio frequency signals upon a radio channel, typically includes one or more up-mixing stages at which the baseband information signal is up-converted in frequency of the selected radio frequency. The mixing stages include mixer circuits coupled to receive the information signal and an up-mixing signal with which the information signal is to be multiplied, or otherwise combined to form an up-converted signal. When multiple mixing stages are utilized, an IF (Intermediate Frequency) signal is formed at a first, or first series of, mixer stages. A radio frequency signal is formed at the final mixing stage.

A receiver which receives a radio-frequency communication signal transmitted thereto upon a radio communication channel must, analogously, convert the radio frequency signal to a baseband level. One or more down-conversion stages is utilized to down-convert the radio frequency signal to a baseband level.

Both the transmitting and receiving stations include, typically, one or more antenna transducers. The antenna transducer, when coupled to a transmitting station to form a portion thereof, transduces the radio frequency signal generated at the transmitter out of electrical form and into electromagnetic form for transmission upon the radio channel. The antenna transducer, when coupled to a receiving station to form a portion thereof, conversely, transduces radio frequency signals out of electromagnetic form and into electrical form for processing by circuitry of the receiving station.

A radio transceiver, having both a transmitting station and a receiving station to permit two-way communications, sometimes utilizes an antenna transducer which is shared by both the receiving and transmitting portions of the transceiver. A filter duplexer is sometimes utilized if the radio transceiver is operable pursuant to a frequency division multiplexing scheme having separate transmit and receive pass bands.

In a cellular communication system in which portable, mobile stations are utilized by a user to effectuate communications, size and performance considerations are significant factors which are determinative of the suitability of an antenna transducer to form a portion of a radio device. In a portable mobile station operable in a cellular communication system, for instance, size considerations are significant, particularly when the antenna transducer is to be housed within a housing of the mobile station. As the dimensions of the mobile stations increasingly become miniaturized, size considerations of the antenna transducer correspondingly become increasingly significant. And, the gain characteristics of the antenna transducer must be at least good enough to provide adequate pickup of signals transmitted to the mobile station and to facilitate transmission of communication signals generated at the mobile station therefrom.

Mobile stations constructed to provide positioning information of the location of the mobile station utilize GPS (global positioning system) signals generated by GPS satellites. The gain characteristics of the antenna transducer of the mobile station must be great enough to detect the satellite-generated GPS signals.

Any manner by which to facilitate improved antenna transducer performance while permitting the antenna transducer to be of reduced physical dimensions would be advantageous.

It is in light of this background information related to antenna apparatus that the significant improvements of the present invention have evolved.

SUMMARY OF THE INVENTION

The present invention, accordingly, advantageously provides an antenna assembly, and an associated method, for transducing radio frequency signals, such as the radio frequency signals generated by, or received at, a mobile station operable in a cellular, or other, radio communication system.

Through operation of an embodiment of the present invention, a manner is provided by which to form an antenna assembly of dimensions permitting its housing within the housing of the portable mobile station, or other radio device while also exhibiting improved gain characteristics compared to many conventional antenna transducers.

In one aspect of the present invention, an antenna assembly is provided for a mobile station operable in a cellular, or other radio, communication system. The antenna assembly is of dimensions to permit its positioning within the housing of the portable mobile station. And, the gain characteristics of the antenna transducer advantageously permit pickup of communication signals transmitted thereto during operation of the cellular, or other radio, communication system to permit subsequent processing of the signals at the mobile station.

In another aspect of the present invention, the antenna assembly includes an IFA (Inverted F-Antenna) transducer which exhibits circular polarization characteristics. In an exemplary implementation, the antenna transducer forms a TOPIFA (Top-Mounted Inverted F-Antenna) transducer. The TOPIFA is mounted at a printed circuit board at which radio circuitry of the mobile station is also formed. The IFA transducer is connected to a RF (Radio Frequency) port and a ground port formed on the printed circuit board. The IFA transducer extends along at least a portion of the width of the mobile station, within the housing, at a top portion of the mobile station, when operated, in typical manner by a user of the mobile station.

In another aspect of the present invention, the antenna assembly includes an antenna transducer element which is mounted upon a substrate, such as the aforementioned printed circuit board. The dimensions of the substrate are selected responsive to the frequencies at which the portable mobile station, or other radio device of which the antenna assembly forms a portion is operable. The widthwise and lengthwise dimensions of the substrate are selected such that a geometric mean of the widthwise dimension taken together with the lengthwise dimension of the substrate substantially corresponds to a resonance length defined by the frequencies within which the radio device is operable. Through such selection of the dimensions of the substrate, resonant currents are generated at the substrate. A first resonant current is generated in a capacitive direction of resonance, and a second resonant current is generated in an inductive direction of resonance. The capacitive and inductive directions of resonance are substantially perpendicular to each other and cause the antenna assembly to exhibit circular polarization characteristics.

In these and other aspects, therefore, an antenna transducer assembly, and an associated method, is provided for a radio device. The radio device includes radio circuitry having a RF (Radio Frequency) port and a ground port. A first antenna transducer element is coupled at a first portion thereof through the RF port of the radio circuitry. The first antenna transducer is coupled at a second portion thereof to the ground port of the radio circuitry. The RF port and the ground port are formed at a substrate. The substrate is of selected lengthwise and widthwise dimensions such that a capacitive resonance and an inductive resonance are formed of dissimilar phases. The dissimilar phases cause the first antenna transducer element to exhibit circular polarization when coupled to the RF port and to the ground port.

A more complete appreciation of the present invention and the scope thereof can be obtained from the accompanying drawings, which are briefly summarized below, the following detailed description of the presently-preferred embodiment of the invention, and the appended claims.

DETAILED DESCRIPTION OF THE PREFERRED EMBODIMENT

Figure 1:
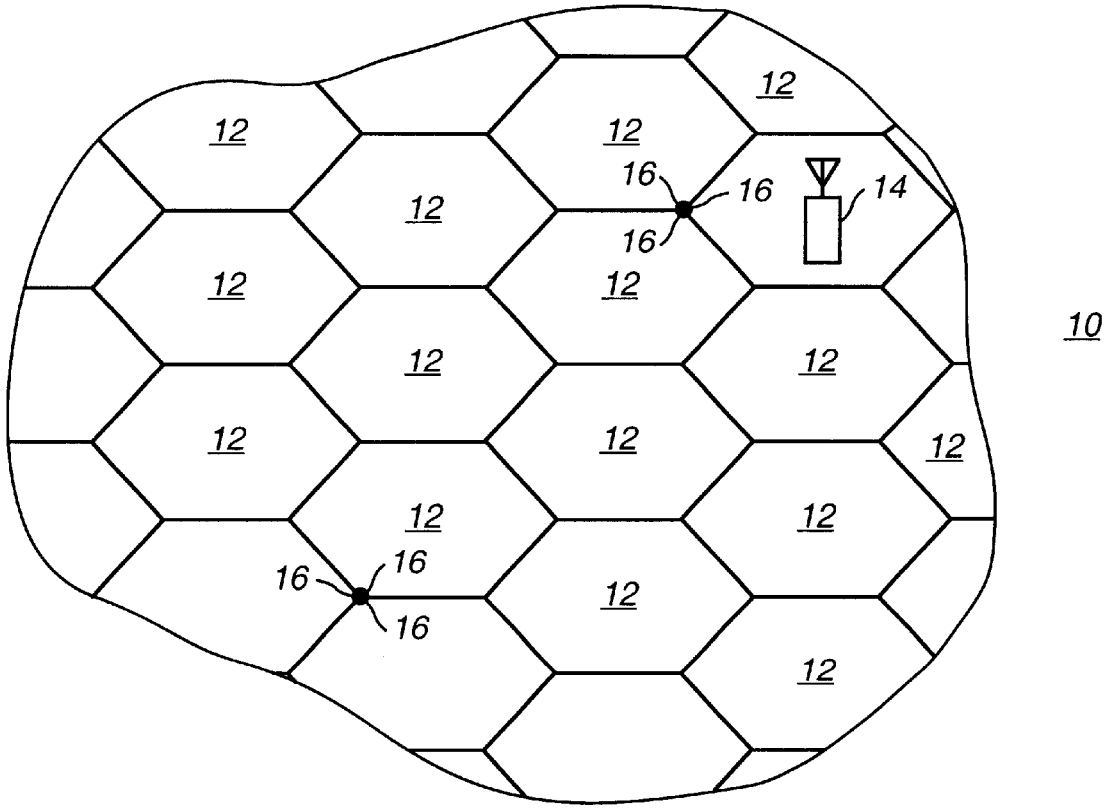
FIG. 1 illustrates a plan view of an exemplary cellular communication system in which a mobile station utilizing an antenna assembly of an embodiment of the present invention is operable.

Referring first to FIG. 1, a portion of a cellular communication system, shown generally at 10, includes a plurality of cells 12 defined upon a geographical area. During operation of the cellular communication system, wireless communications are effectuated by a user of a mobile station 14. While only a single mobile station 14 is shown in the Figure, a cellular communication system is a multi-user system permitting users of a large number of mobile stations to communicate concurrently therethrough. In an exemplary implementation, an embodiment of the present invention forms a portion of a mobile station, such as the mobile station 14.

The cells 12 of the communication system are defined by fixed-site radio base stations 16. A cell 12 is a portion of the geographical area encompassed by the cellular communication system and within which communications between a mobile station and a radio base station which defines such cell generally can be effectuated. In the portion of the system shown in the Figure, three radio base stations are co-located, and each radio base station defines a sector cell in conventional manner.

Effectuation of radio communications between a mobile station 14 and a radio base station 16 is facilitated through operation of an embodiment of the present invention. A mobile station 14 constructed pursuant to an embodiment of the present invention improves communication qualities of communications between the mobile station and a radio base station and a radio base station are facilitated by providing an antenna assembly for the mobile station which exhibits good gain characteristics while also being of dimensions permitting its housing within the housing of a mobile station.

FIG. 2 again illustrates the mobile station 14, shown in FIG. 1 to form a portion of the cellular communication system 10. The mobile station 14 includes transceiver circuitry 26, thereby to permit two-way communication between the mobile station and a radio base station. The transceiver circuitry 26 includes a receiver portion having a receive path including a receive filter portion 28 of a filter duplexer 30. The receiver portion includes, for instance, down-conversion and demodulation circuitry 32 and a data sink 34. The transceiver circuitry 36 further includes a transmitter portion having a transmit path including a data source 38 and transmit circuitry 40. The transmit circuitry 40 includes, for instance, modulation and up-conversion circuitry and further includes a transmit filter portion 42 of the filter duplexer 30. Both of the filter portions 28 and 42 of the filter duplexer 30 are coupled to an antenna transducer 44 which forms a portion of an embodiment of the present invention. The filter portions 28 and 42 are coupled to the antenna transducer 44 by way of a RF (Radio Frequency) port 46. The antenna transducer is further coupled to an electrical ground plane 48 by way of a ground port 52. While not separately shown, portions of the transceiver circuitry 26 are also coupled to the ground plane 48. The antenna transducer is operable during operation of the mobile station 14 to transducer communication signals into and out of electromagnetic form.

Figure 2:
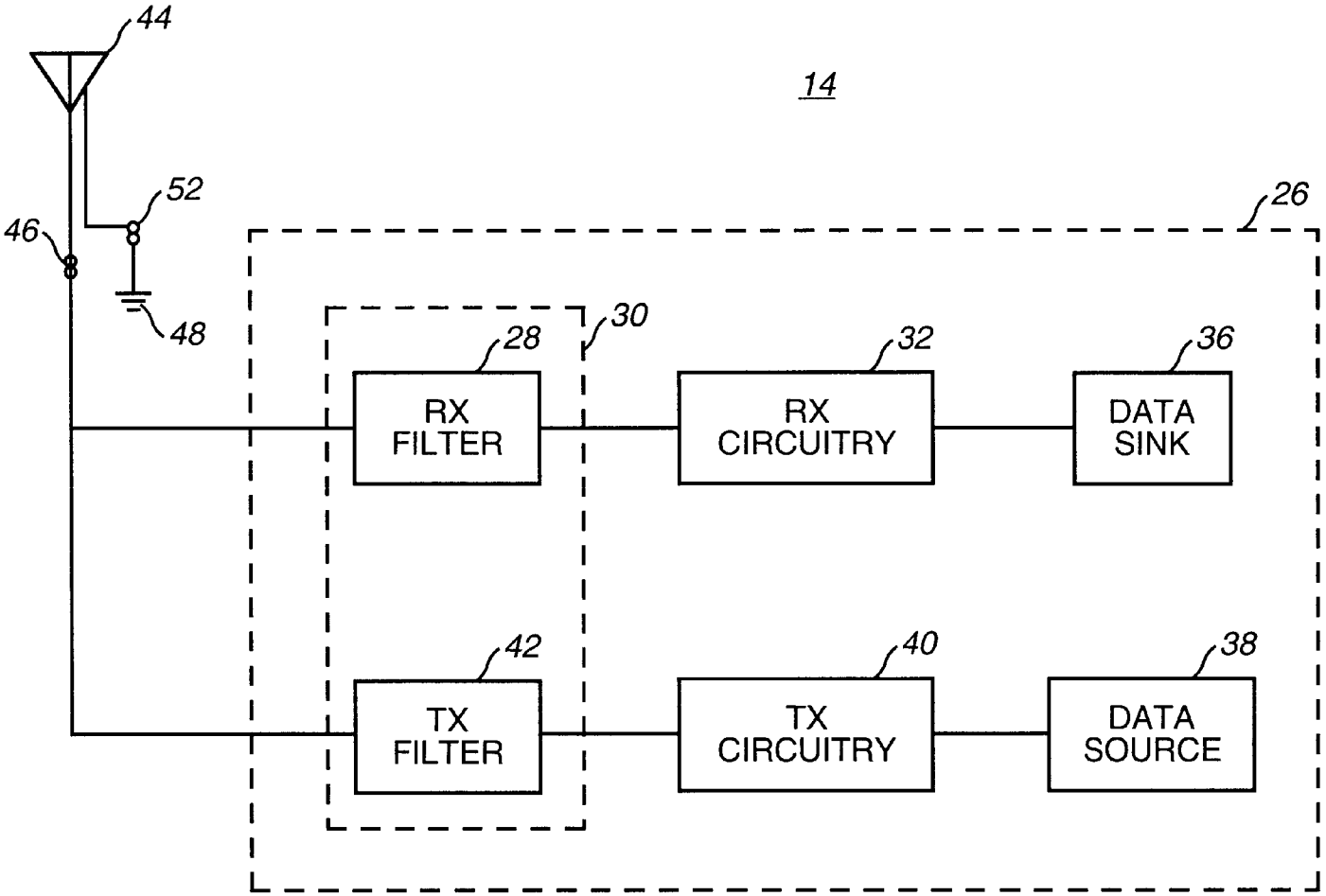
FIG. 2 illustrates a functional block diagram of a mobile station, or other radio transceiver, which includes an antenna assembly of an embodiment of the present invention.
Figure 3:
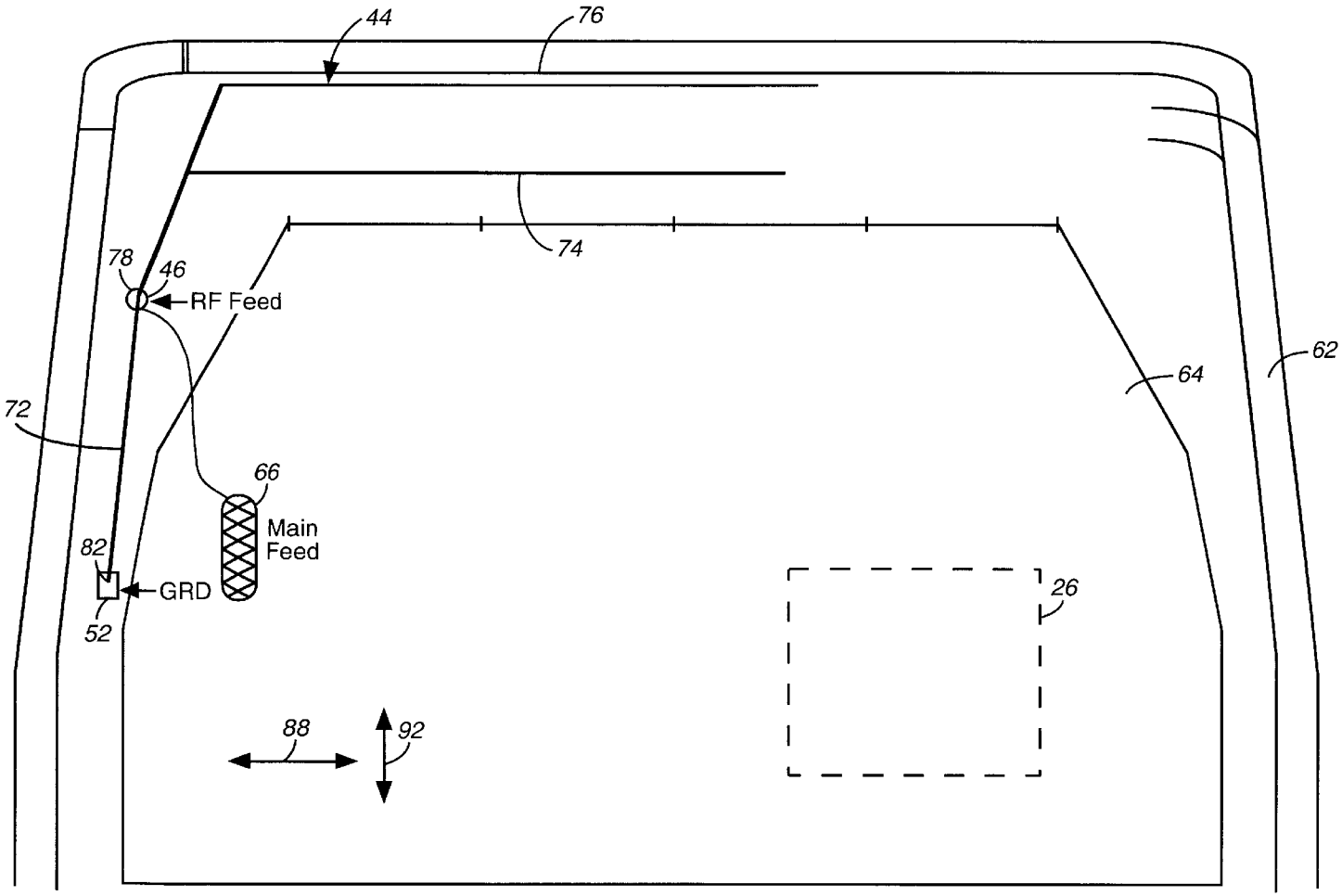
FIG. 3 illustrates a partial plan view, partial functional view of a portion of the mobile station shown in FIG. 2.
Figure 4:
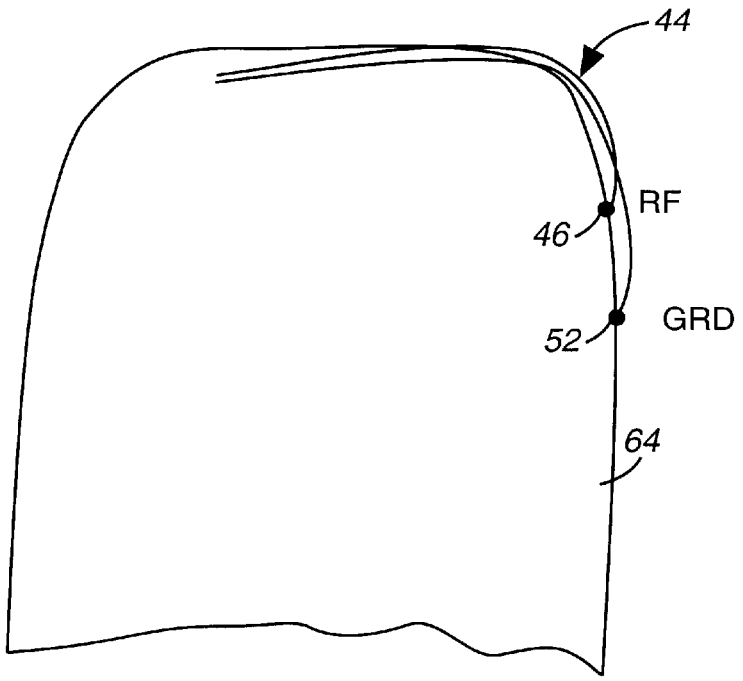
FIGS. 4, 5, 6, 7, 8, 9 and 10 illustrate views of portions of the mobile station, similar to that shown in FIG. 2, but of alternate embodiments of the present invention.
Figure 5:
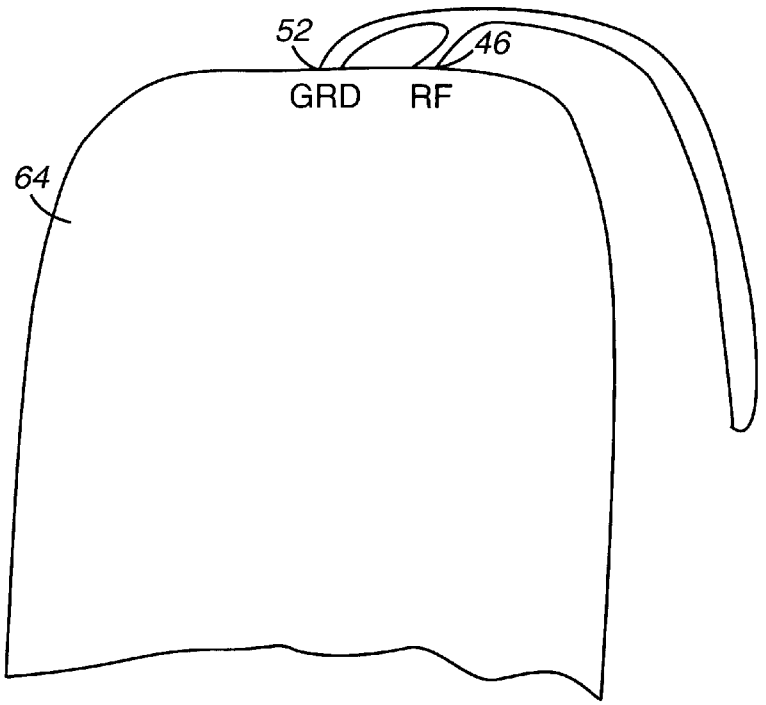
Figure 6:
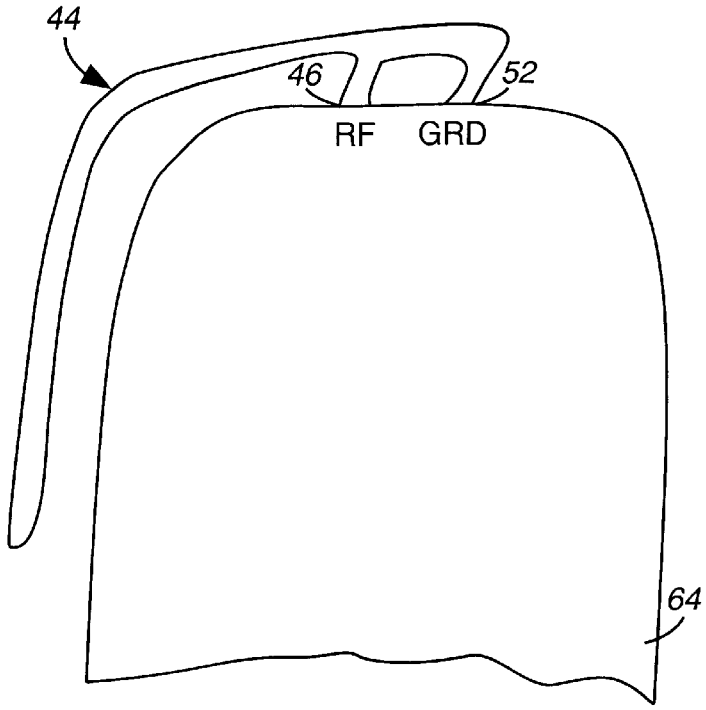
Figure 7:
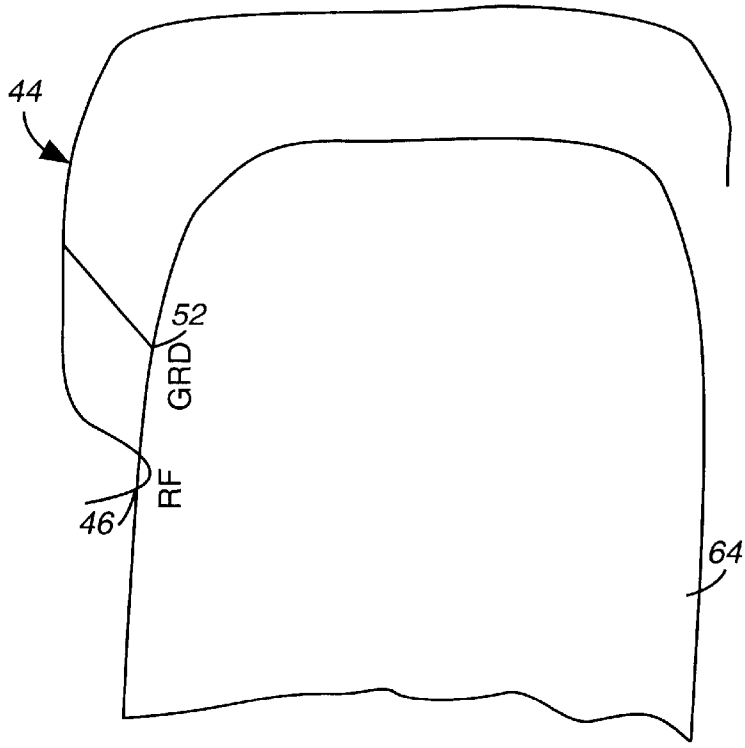
Figure 8:
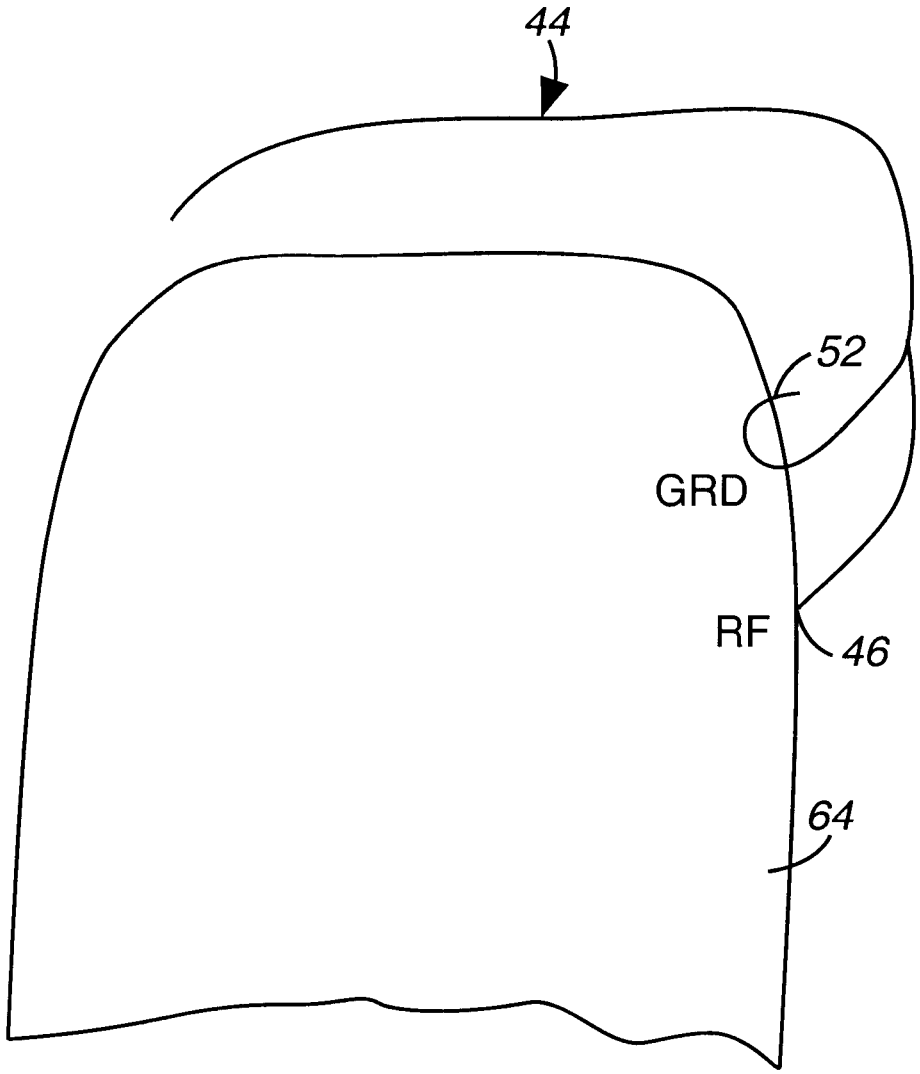
Figure 9:
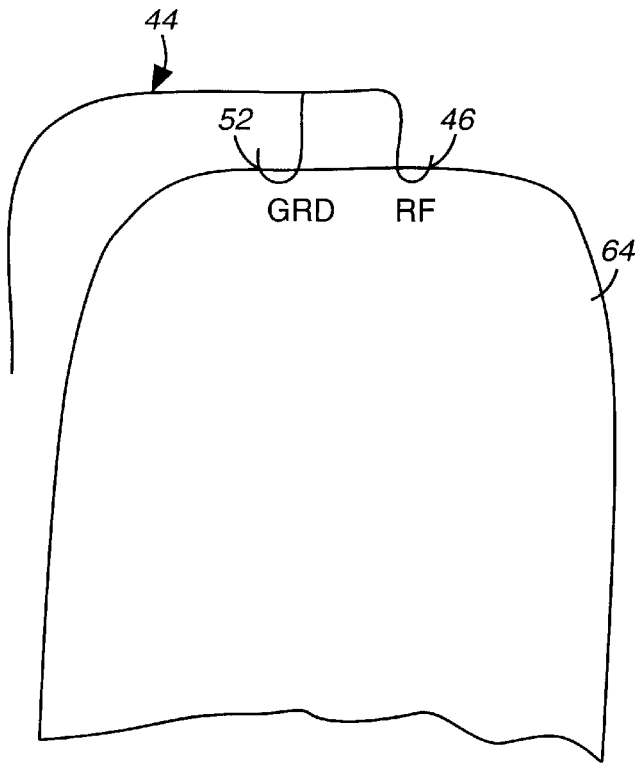
Figure 10:
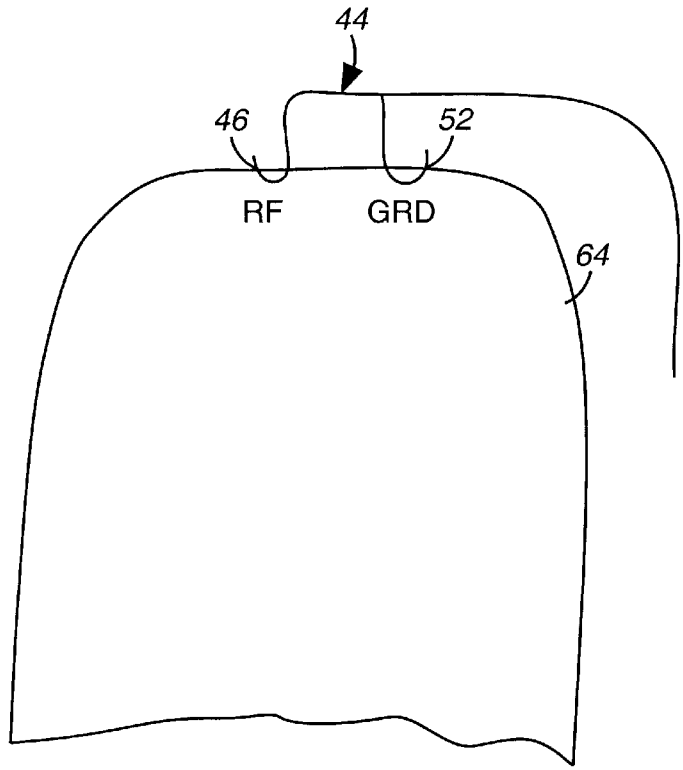

FIG. 3 illustrates a portion of the mobile station shown in FIGS. 1–2. The portion of the mobile station illustrated in the Figure is shown to include a housing 62, here formed of a molded, thermoplastic material. The housing 62 forms a supportive enclosure for supportively enclosing the transceiver circuitry 26 of which at least portions of the circuitry 26 are supported upon a printed circuit board forming a substrate 64. A RF (Radio Frequency) port 46 is electrically connected to a main feed port 66 formed on the substrate 64 and electrically connected, in turn, with the radio transceiver circuitry 26. The ground port 52 is also shown in the Figure.

The antenna transducer element 44 is here shown to be a TOPIFA (Top-Mounted Inverted F-Antenna) transducer. The antenna transducer element is here shown to include an elongated member 72, a first transverse-extending piece 74, and a second transverse-extending piece 76. The transverse-extending pieces 74 and 76 extend in directions generally transverse to the longitudinal direction of the elongated member 72. Downwardly-projecting (as shown) contacts 78 and 82 project beneath the elongated member 72 to engage with, and become electrically connected to, the ports 46 and 52, respectively. The antenna transducer element 44 is positioned at a selected elevation above the substrate 64 and, here, is positioned to extend at an elevation of approximately 4 mm above the substrate 64.

While a conventional TOPIFA transducer generally exhibits linear polarization characteristics, through operation of an embodiment of the present invention, the antenna transducer element 44 caused, instead, to exhibit circular polarization characteristics. Improved gain characteristics are, thereby, provided. And, while not separately shown, the antenna transducer element 44 is positionable proximate to a convention whip antenna transducer selectably connectable also to the radio transceiver circuitry 26. For instance, in the exemplary implementation, the antenna transducer element 44 is positioned beneath a conventional whip antenna transducer, separated therefrom at a distance of approximately 4 mm.

The substrate 64 is of selected widthwise and lengthwise dimensions, not only to permit positioning thereof within the housing 62 but also to cause the polarization exhibited by the antenna transducer element to be circular.

Namely, the widthwise dimension, indicated by the arrow 88 and the value of the lengthwise dimension, indicated by the arrow 92, are combined together to form a geometric mean value. The mean value of the widthwise and lengthwise dimensions of the substrate are selected to substantially correspond to the resonance length at which the mobile station is to be operable. For instance, when the mobile station is operable in the range of 1.5 gigahertz (GHz), the resonance length is related to the wavelength associated with a 1.5 GHz signal. By selecting the dimensions of the substrate 64 in this manner, resonant currents are generated in the substrate. The resonant currents form first and second resonant currents generated in a capacitive direction and in an inductive direction of resonance. The inductive and capacitive directions of resonances extend in perpendicular directions, thereby to form a circular resonant structure.

FIGS. 4, 5, 6, 7, 8, 9, and 10 illustrate portions of the mobile station 12 having alternate antenna transducer element configurations. In each configuration, again, the transducer element is coupled to RF and ground ports 46 and 52, respectively, formed at the substrate 64. In the various alternate configurations, the RF and ground ports are positioned at various end sides, or at the top (or bottom) side, of the substrate. And, the configuration of the antenna transducer is appropriately selected, depending, in part, upon the locations of the RF and ground ports.

In an exemplary implementation, the antenna transducer element 44 is utilized in a mobile station operable pursuant to conventional cellular operation as well as also to receive GPS signals used for positioning purposes. Because of the circular polarization characteristics of the resultant antenna transducer, a relatively high antenna gain characteristic is provided by the antenna transducer. The antenna transducer also exhibits broad beam characteristics to permit the antenna transducer ably to receive signals over much of the horizon. And, because of the lightweight and compact size of the antenna transducer, the antenna transducer is easily positionable within the housing 62 of the mobile station.

Thereby, a manner is provided by which to add an improved antenna transducer for a radio device, such as a portable mobile station. The antenna transducer element is of dimension permitting its housing within the housing of the mobile station and which also exhibits circular polarization characteristics and high gain characteristics.

The previous descriptions are of preferred examples for implementing the invention, and the scope of the invention should not necessarily be limited by this description. The scope of the present invention is defined by the following claims.

I claim:

1. An antenna transducer assembly for a radio device, the radio device including radio circuitry having a RF port and a ground port, and the radio device operable within a selected frequency range, frequencies of the selected frequency range determinative of a resonance length, said antenna transducer assembly comprising:

a first antenna transducer element coupled at a first portion thereof to the RF port of the radio circuitry and at a second portion thereof to the ground port of the radio circuitry; and a substrate to which the RF port and the ground port are coupled, said substrate of a selected lengthwise dimension and a selected widthwise dimension such that a capacitive resonance and an inductive resonance are formed of dissimilar phases, the selected lengthwise dimension and the selected widthwise dimension of sizes such that a geometric mean defined by the selected lengthwise dimension taken together with the selected widthwise dimension substantially corresponds with the resonance length, the dissimilar phases and the geometric mean, substantially corresponding to the resonance length, causing said first antenna transducer element to exhibit circular polarization when coupled to the RF port and to the ground port.

2. The antenna transducer assembly of claim 1 wherein the radio device comprises a radio housing and wherein said substrate is housed within the housing of the radio device.

3. The antenna transducer assembly of claim 2 wherein said first antenna transducer is further housed within the housing of the radio device.

4. The antenna transducer assembly of claim 1 wherein said first antenna transducer element comprises an inverted F-shaped antenna transducer.

5. The antenna transducer assembly of claim 4 wherein said inverted F-shaped antenna transducer of which said first antenna transducer element is comprised forms a Top-Mounted Inverted-F Antenna.

6. The antenna transducer assembly of claim 1 wherein said first antenna transducer element comprises an elongated body portion positioned above a top face surface of said substrate.

7. The antenna transducer assembly of claim 6 wherein said first antenna transducer element further comprises a first contact piece, said first contact piece positioned upon said elongated body, and said first contact piece positionable to connect with the RF port.

8. The antenna transducer assembly of claim 7 wherein said first antenna transducer element further comprises a second contact piece, said second contact piece positioned upon said elongated body, said second contact piece positionable to connect with the ground port.

9. The antenna transducer assembly of claim 6 wherein said first antenna transducer element further comprises a first transverse-extending piece, said first transverse-extending piece extending in a direction substantially transverse to the elongated body.

10. The antenna transducer assembly of claim 9 wherein said first antenna transducer element further comprises a second transverse-extending piece, said second transverse-extending piece also extending in a direction substantially transverse to the elongated body and spaced-apart from the first transverse-extending piece.

11. The antenna transducer assembly of claim 1 wherein the selected widthwise dimension of said substrate is less than the selected lengthwise dimension thereof.

12. The antenna transducer assembly of claim 1 wherein resonant currents are generated at said substrate.

13. The antenna transducer assembly of claim 12 wherein the resonant currents generated at said substrate comprises a first resonant current generated in a capacitive direction of resonance and a second resonant current generated in an inductive direction of resonance, the capacitive and inductive directions of resonance, respectively, substantially perpendicular to each other.

14. A method of transducing communication signals at a radio device, the radio device including radio circuitry having a RF port and a ground port, and the radio device operable within a selected frequency range, frequencies of the selected frequency range determinative of a resonance length, said method comprising:

coupling the RF port and the ground port to a substrate, the substrate of a selected lengthwise dimension and a selected widthwise dimension such that a capacitive resonance and an inductive resonance are formed of dissimilar phases the selected lengthwise dimension and the selected widthwise dimension of sizes such that a geometric mean defined by the selected lengthwise dimension taken together with the selected widthwise dimension substantially corresponds with the resonance length;

attaching a first antenna transducer element at a first portion thereof to the RF port and at a second portion thereof to the ground port such that, when the first antenna transducer is attached to the RF and ground ports, respectively, the first antenna transducer element exhibits circular polarization.

15. The method of claim 14 wherein the first antenna transducer element attached during said operation of attaching comprises an Inverted F-shaped Antenna transducer.

16. The method of claim 15 wherein the selected widthwise dimension of the substrate to which the RF port and the ground port are coupled during said operation of coupling is less than the selected lengthwise dimension thereof.

17. The method of claim 14 further comprising the operation of inducing generation of resonant currents at the substrate.

18. The method of claim 17 wherein the resonant currents generated during said operation of inducing generation comprise a first resonant current generated in a capacitive direction and a second resonant current generated in an inductive direction of resonance.

* * * * *